US006345848B1

(12) United States Patent
Baader et al.

(10) Patent No.: US 6,345,848 B1
(45) Date of Patent: Feb. 12, 2002

(54) LOCKING APPARATUS, FOR EXAMPLE, FOR HOUSEHOLD DEVICE DOORS

(75) Inventors: Helmut Baader, Nabburg; Hubert Harrer, Hiltpoltstein; Günther Hengelein, Altdorf, all of (DE)

(73) Assignee: Ellenberger & Poensgen GmbH, Nürnberg (DE)

( * ) Notice: Subject to any disclaimer, the term of this patent is extended or adjusted under 35 U.S.C. 154(b) by 0 days.

(21) Appl. No.: 09/432,810

(22) Filed: Nov. 4, 1999

(30) Foreign Application Priority Data

Nov. 4, 1998 (DE) ..... 198 50 815
Nov. 14, 1998 (DE) ..... 198 52 578

(51) Int. Cl.[7] ..... E05B 15/02
(52) U.S. Cl. ..... 292/341.16; 292/DIG. 66
(58) Field of Search ..... 292/125, 156, 292/157, 144, 341.16, 28, DIG. 69, DIG. 66; 337/70, 71; 68/12.26; 70/DIG. 10

(56) References Cited

U.S. PATENT DOCUMENTS 3,540,767 A * 11/1970 Siegel ..... 292/210
3,617,957 A * 11/1971 Brighenti ..... 337/77
3,638,636 A * 2/1972 Phifer ..... 126/197
4,321,445 A * 3/1982 Kristof ..... 219/10.55
4,717,794 A * 1/1988 Paul ..... 200/50
4,718,705 A * 1/1988 Case ..... 292/201
4,988,132 A * 1/1991 Rocchitelli ..... 292/144

FOREIGN PATENT DOCUMENTS

| | | | |
|---|---|---|---|
| DE | 2 044 787 | 6/1972 | |
| DE | 88 06 999 | 9/1977 | |
| DE | 29 07 201 | 9/1979 | |
| DE | 42 22 536 | 1/1994 | |
| DE | 37 09 660 | 11/1994 | |
| DE | 196 01228 | 11/1999 | |
| EP | 347592 | 5/1989 | |
| FR | 2477620 | * 9/1981 | ..... E05C/13/10 |

* cited by examiner

*Primary Examiner*—Gary Estremsky
(74) *Attorney, Agent, or Firm*—Venable; Gabor J. Kelemen; Allen Wood

(57) ABSTRACT

The locking movement and/or the unlocking movement of a bimetallic drive of an electrothermally-controlled locking apparatus, for example for household-device doors, is or are driven by a separate bimetal member (10, 11) over only a first segment of its movement path. In the process, energy is supplied to the energy store (28) of a tipping over-center device until a dead-center position is attained, the energy being released as a moving drive for the remaining segment of the movement path when the dead-center position is exceeded, thereby cutting off the bimetal drive and stabilizing the locking member (2) in its end position.

19 Claims, 5 Drawing Sheets

LOCKING APPARATUS, FOR EXAMPLE, FOR HOUSEHOLD DEVICE DOORS

BACKGROUND OF THE INVENTION

The invention relates to a locking apparatus, for example for household-device doors, having a locking member that can be moved between an open and a closed position by a bimetallic drive.

Bimetal-controlled locking apparatuses for household-device doors are generally known. In a lock for a washing-machine door, in particular, which is known from DE 37 09 660 C2, a bimetallic snap disk is provided as the drive for a stopper that blocks the manually-operated locking member in the locked position. This bimetallic snap disk assures, on the one hand, a rapid blockage of the lock by the stopper when heating occurs. After such a blockage, the heating current for the bimetal snap disk is cut off. As it cools, the disk returns to its open position. The bimetallic heating of the snap disk serves solely to move a stopper for a blocking member, not directly for the locking member.

SUMMARY OF THE INVENTION

The present object is to ensure, with simple means, that a locked door cannot be opened, even with an interruption or breakdown of voltage. This is especially important for household devices that operate at very high temperatures. In these cases, the locked state must be maintained until cooling to non-dangerous levels has occurred, even if the current supply fails.

In addition to the high safety requirements, a particular object is to produce the locking apparatus simply, and therefore inexpensively. It should be compact so as not to limit the freedom in the designing of the device. Finally, the apparatus should operate in an energy-saving and environmentally-friendly manner, e.g., quietly.

These objects are accomplished or facilitated by a locking apparatus which is characterized in that the locking movement and the unlocking movement are respectively driven by separate bimetal members over only a first segment of their movement path, thereby supplying energy to the energy store of a tipping over-center device until a dead-center position has been attained, the energy being re-released when the dead-center position of the tipping over-center device has been exceeded, and used as a movement drive for the remaining segment of the movement path, and stabilizing the locking member in its end position at the end of the respective movement path. The bimetallic drives directly control the locking and unlocking movements, and not only a stopper that blocks the mobility of the locking member in the closed position. Power consumption only occurs during the switching process, and then only for controlling the first component of the locking or unlocking movement until the dead-center position of the tipping over-center device has been exceeded. Afterward, the tipping over-center device assumes control of not only the second component, that is, the completion, of the displacement movement or switching process, but preferably also the cutoff of the electrical bimetal heating. The functional system is therefore currentless once the dead-center position of the tipping over-center device has been exceeded; the locking or unlocking position is nevertheless stable. Both the locking and unlocking movements are preferably controlled in this manner. The attained end state—that is, the locked and unlocked positions—is stable. The entire system is bistable.

A further, special advantage lies in the structurally simple and, most importantly, compact construction that is attained particularly by a lowered positioning of the locking bar in comparison to the two bimetal members. Using a locking bar or a drive member that is inserted into or rests upon the moving ends of the two bimetal members permits an especially lowfriction drive of the locking bar, on which the bimetals act practically directly. The fact that the locking bar in the preferred embodiment is configured in two parts due to its position straddling a drive element that is disposed parallel to it and performs the same drive function has its basis in production and assembly considerations. The two parts could also be connected to one another to form a one-piece locking bar. This two-part embodiment offers a suspended retention and seating of the coupling-bridge drive member at the ends of the bimetals, without bearing forces that act on the locking bar acting on the coupling bridge, and thus the bimetals, thereby impairing the suspended seating of the coupling bridge, which is kept in contact with the bimetal ends by the energy store of the tipping over-center device.

Furthermore, the coupling bridge and the locking bar encapsulate the tipping over-center device between them, shielding it from the bimetal drive. All of the movements of the functional parts of the locking apparatus are completed in the longitudinal plane of the housing. This also facilitates an easy-to-assemble design.

DESCRIPTION OF THE PREFERRED EMBODIMENTS

Figure 1:
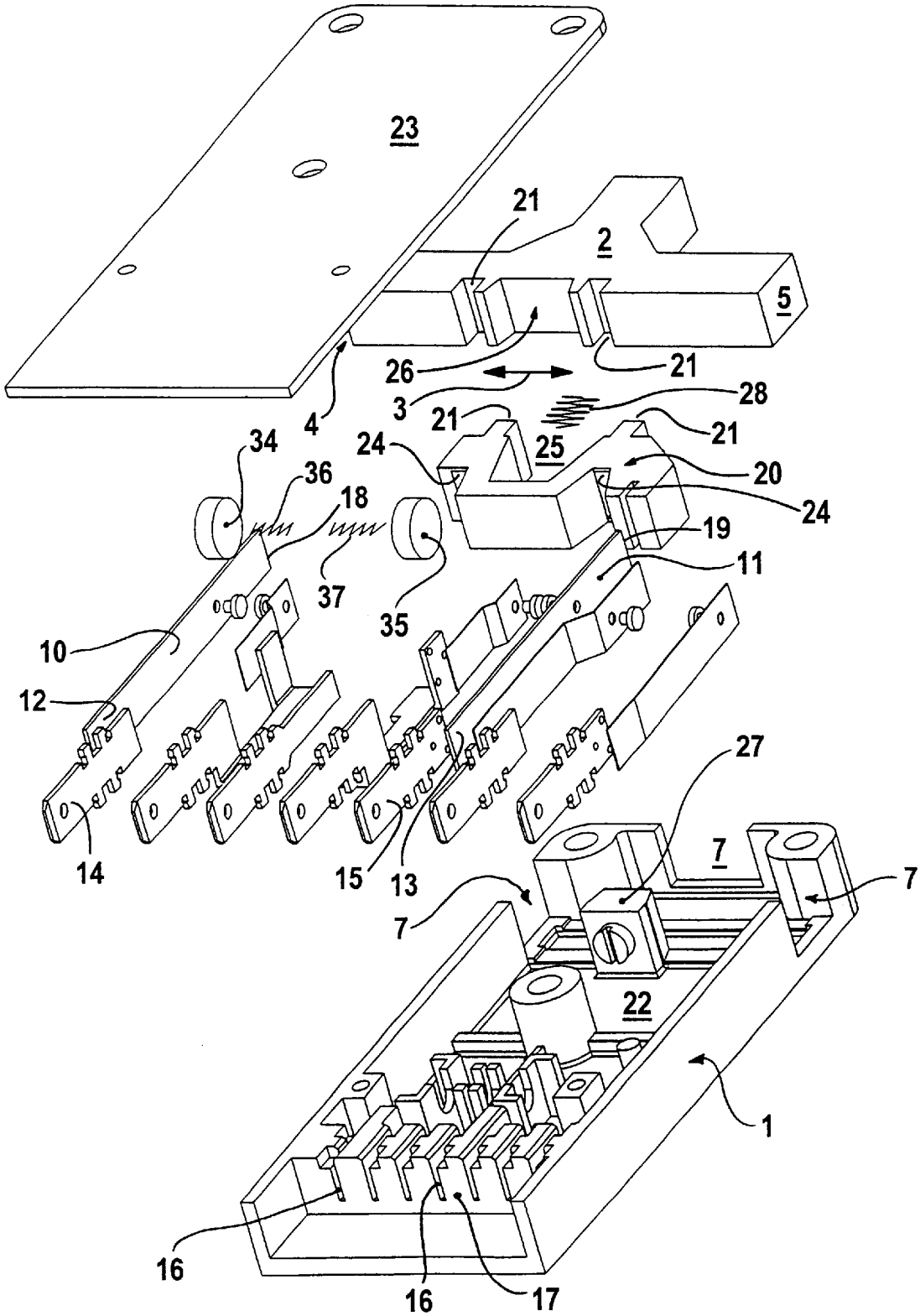
FIG. 1 is an exploded view of the locking apparatus with all of its individual parts that are necessary for functioning.
Figure 2:
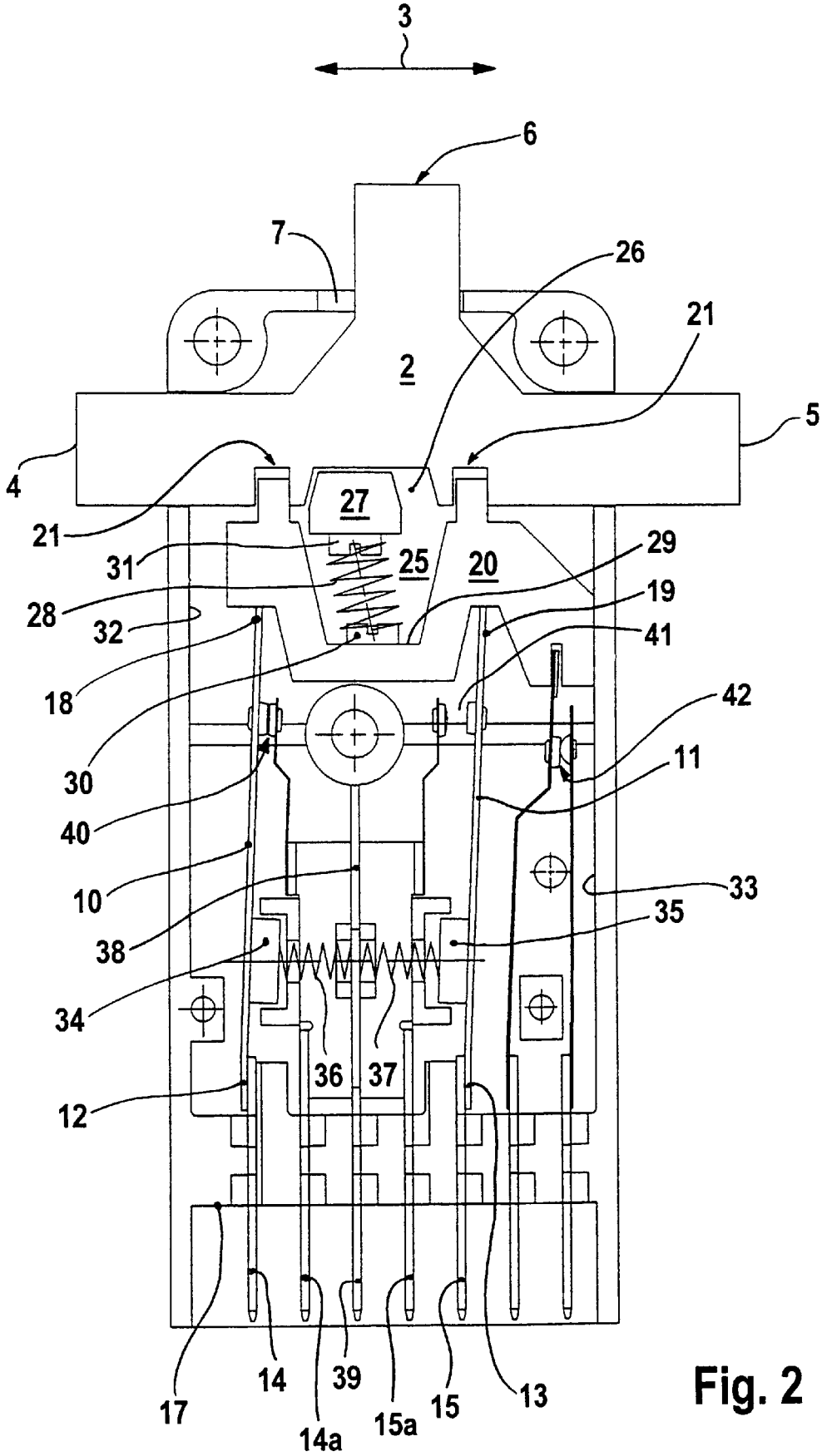
FIG. 2 is a plan view of the lower part of the housing with all of the essential functional parts of the locking apparatus inserted, and in the unlocked position of the locking bar.
Figure 3:
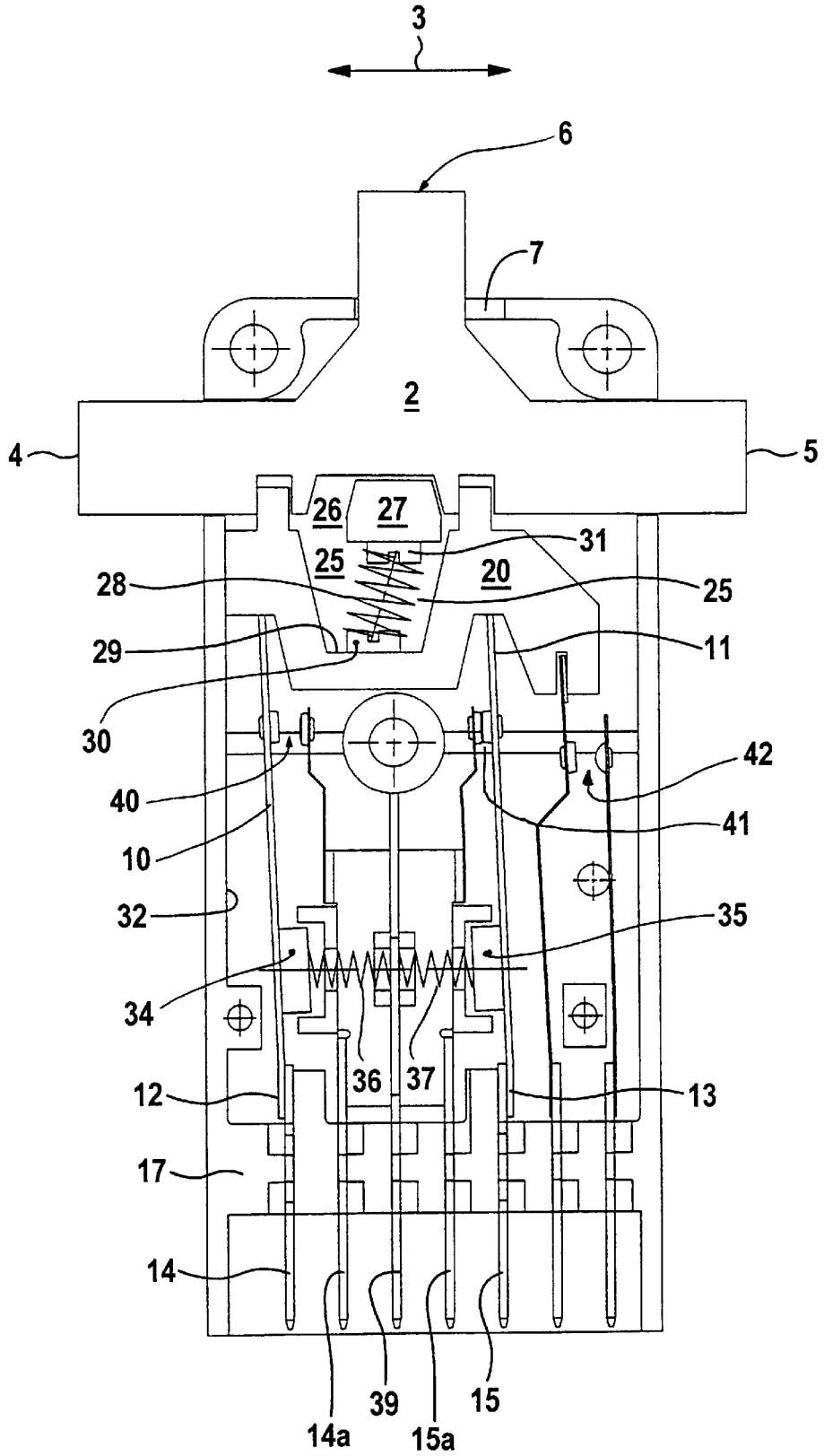
FIG. 3 is a representation analogous to FIG. 2, with the locking bar in the locked position.
Figure 5:
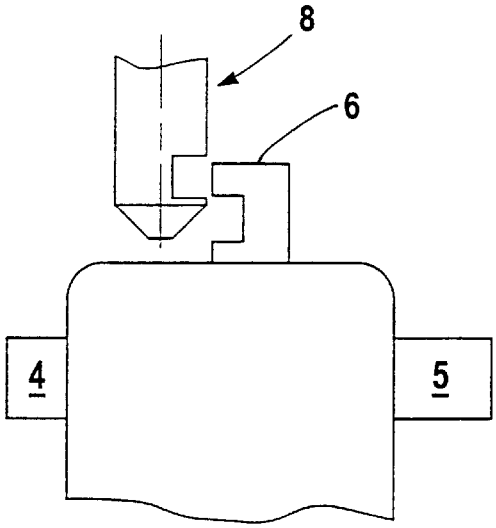
FIGS. 5 and 7 are views showing the effect of the locking bar on structurally different door-locking systems in a respective unlocked position of a door.
Figure 6:
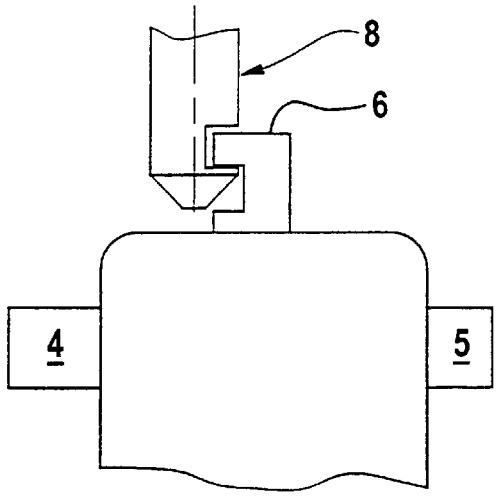
FIGS. 6 and 8 are representations analogous to FIGS. 5 and 7, in a respective locked position of the locking bar.
Figure 7:
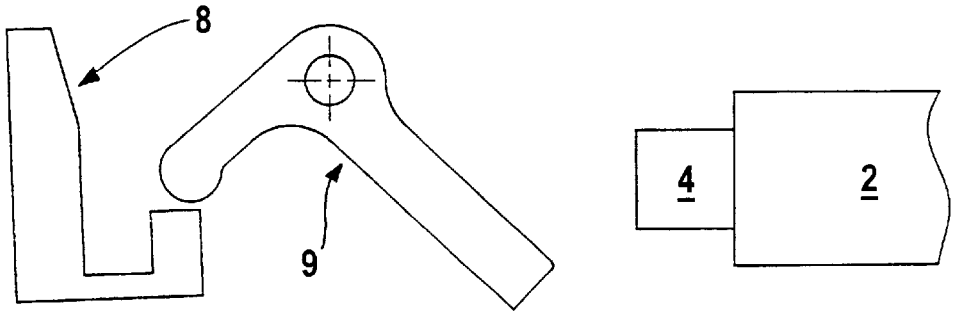
Figure 8:
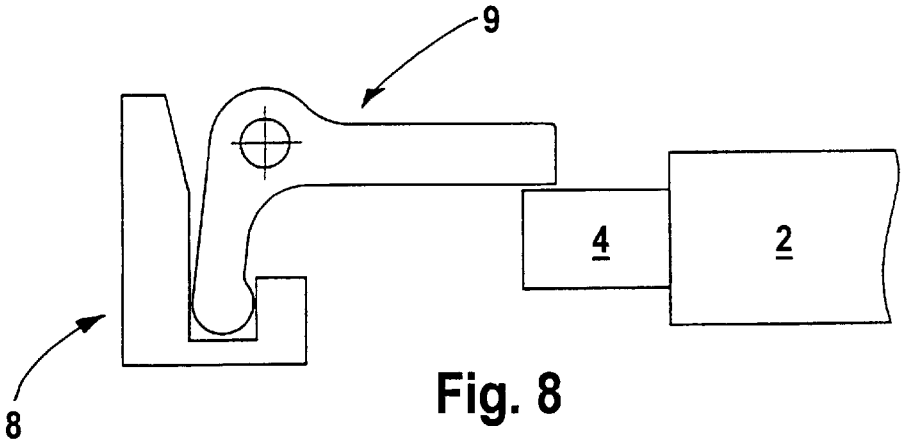

Inside the lower part 1 of the housing, which comprises an insulating material, a locking bar 2 is seated to be longitudinally displaced in the transverse direction 3 between its unlocked position (FIG. 2) and a locked position (FIG. 3). The bar has the outline of an upside-down down T; the two horizontal ends 4, 5 of the T crosspiece and the free vertical end 6 of the long piece project outwardly through housing openings 7 in the side walls of the lower part 1 of the housing. The ends 4–6 are the driving ends of the locking bar 2, and act directly (FIGS. 5, 6) with door-side locking elements 8, or indirectly via interposed transmission members 9, for example in the form of a pivoting lever. The locking elements 8 are components of a device door to be locked, for example.

Two bimetal members 10, 11, which will frequently be called simply "bimetals" hereafter, are disposed approximately perpendicular to the transverse direction 3 inside the lower part 1 of the housing. The bimetals are strip-shaped. The strip plane extends perpendicular to the drawing plane of FIGS. 1 through 4. The strip planes extend parallel to one another, and maintain a specific lateral spacing between themselves. The bimetals are fixed on the side of the housing by their foot ends 12, 13. They are welded there to the reeds 14, 15, which are fixedly positioned in slots 16 inside the housing side wall 17; the contact ends of the reeds project from the housing interior so as to be contacted externally (FIGS. 2, 3).

Figure 4:
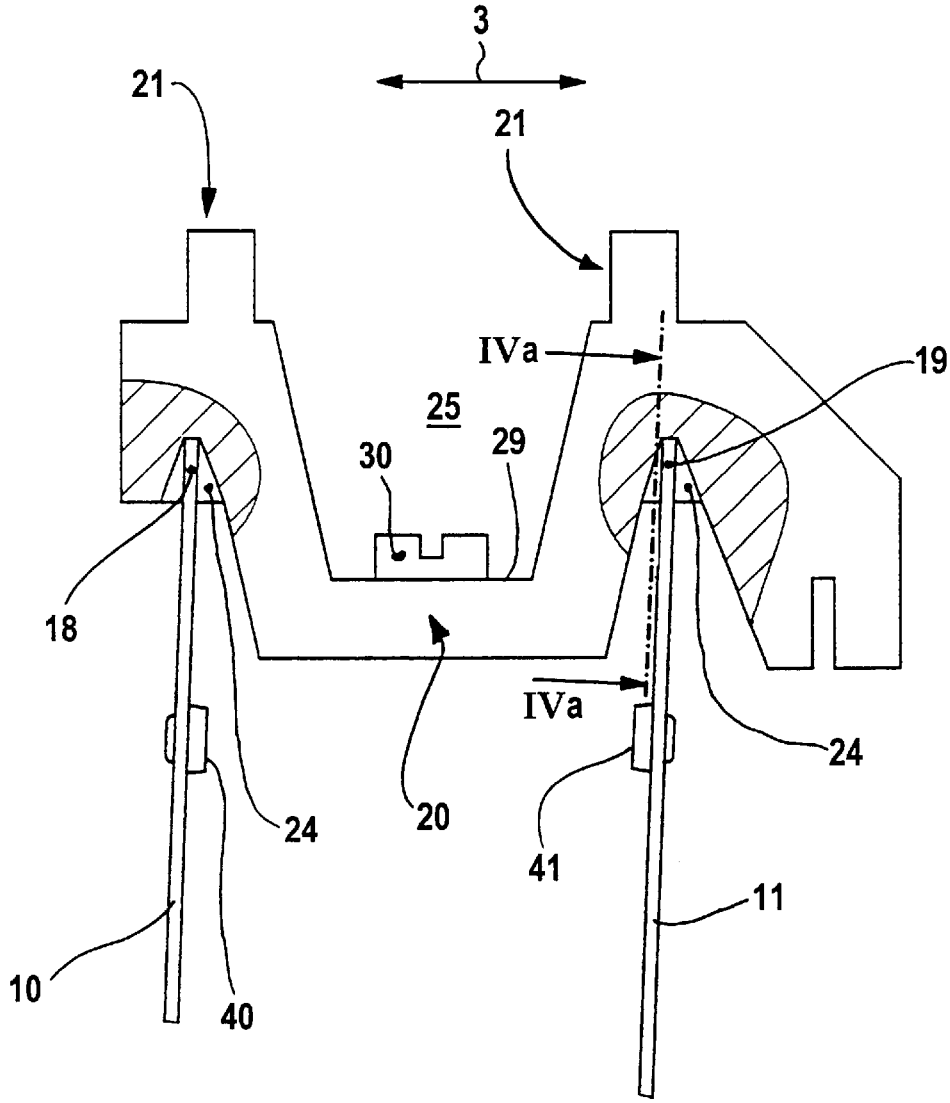
FIG. 4 is a representation of the driving connection between the moving ends of the bimetals and the coupling bridge.
Figure 4A:
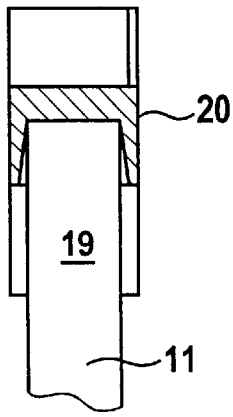
FIG. 4*a* is a cutout IVa—IVa in FIG. 4 relating to the knife-edge seating of the coupling bridge on the bimetal ends.

The moving ends 18, 19 of the bimetals 10, 11 indirectly engage the locking bar 2, which is displaceable in the transverse direction 3. This indirect engagement is only present as long as a coupling bridge 20 is interposed between the moving ends 18, 19 of the bimetals 10, 11 and the actual locking bar 2; the bridge, however, is viewed as a functional component of the locking bar 2 because of its form-fitting engagement 21 with the locking bar 2, and its identical driving action, and its position parallel to the locking bar 2. The two-part embodiment of the coupling bridge 20 and the locking bar 2 is based on production and assembly considerations. In the plan view, the two bimetals 10, 11 and the locking bar 2, or its coupling bridge 20, together form the two vertical legs and the horizontal leg mounted on them to form an overall shape corresponding to the Greek letter Π. In terms of assembly, the locking bar 2 or the coupling bridge 20 is respectively positioned on the moving ends 18, 19 of the two bimetals 10, 11. The two bimetals 10, 11, like the two support pillars of a bridge head, thus function as support elements for the coupling bridge 20, which is guided longitudinally by the housing floor 22 and the housing lid 23 as lateral guides when the housing is in its final assembly state. This seating or retention of the coupling bridge 20 is especially low-friction, and therefore energy-saving. The bimetals 10, 11 project with their moving ends 18, 19 into recesses 24 at the flank of the coupling bridge 20 facing them. The recesses 24 function as a knife-edge bearing (FIG. 4). Their cross-section walls also provide displacement protection for the moving ends 18, 19 of the bimetals 10, 11. The coupling bridge 20 is therefore suspended freely on the bimetal ends 18, 19, and is guided in its movement solely by the bimetals 10, 11. No additional guidance system is required for the displacement movement of the coupling bridge 20 within the housing 1, although such a system should not be precluded by the housing floor 22 or housing lid 23. The coupling bridge 20 is thus practically inserted onto the ends of the bimetals 10, 11.

The coupling bridge 20 is connected to the locking bar 2 through a loose, form-fitting engagement 21. This engagement transmits the drive movement of the bimetals 10, 11 onto the locking bar 2 without transmitting bearing pressures that act on the locking bar onto the coupling bridge 20, and consequently indirectly onto the bimetals 10, 11, thereby influencing and possibly impeding their functioning capability.

On the side facing the locking bar 2, the coupling bridge 20 is hollowed out (trough 25) between the two recesses 24 for the moving ends 18, 19 of the bimetals 10, 11, that is, between their pins, for a form-fitting engagement 21 at the locking bar 2. The locking bar 2 has a countertrough 26 on the side facing the coupling bridge 20, the countertrough corresponding to the trough 25. The troughs 25, 26 encompass a hollow space, into which a housing projection 27 projects from the housing floor 22. The housing projection 27 constitutes the housing-side support for the tipping spring 28, whose lower end acts on the floor 29 of the trough 25 of the coupling bridge 20. The screw heads 30, 31 of retaining screws that engage the spring winding serve to center the two ends of the tipping spring 28 at the coupling bridge 20 and the housing projection 27, respectively. The tipping spring 28 constitutes the energy store of a tipping over-center device, which is shown in its two tipped positions in FIGS. 2 and 3, namely the locked position (FIG. 3) and the unlocked position (FIG. 2). In these positions, the tipping spring 28 acts on the coupling bridge 20 in the transverse direction 3 such that the bridge ends lie against either the left side wall 32 (FIG. 3) in the locked position or the right housing wall 33 (FIG. 2) in the unlocked position. This contact with the housing effects a stable positioning of the coupling bridge 20 or the locking bar 2 in the locked position (FIG. 3) and in the unlocked position (FIG. 2), regardless of the voltage. The housing projection 27 is simultaneously a component of the housing-side longitudinal guidance for the locking bar 2, as can be seen clearly in FIGS. 1 through 3. Moreover, the tipping spring 28 holds the coupling bridge 20 securely on the moving ends 18, 19 of the bimetals 10, 11 in all of its positions.

The coupling bridge 20 is seated completely frictionless on the drive ends 18, 19 of the bimetals 10, 11. The tipping spring 28 acting from above on the coupling bridge 20 between the two drive ends 18, 19 stabilizes this arrangement. The housing walls, which also form end stops for the two-sided displacement movements, can also effect the guidance of the locking bar 2 or the coupling bridge 20 inside the housing 1.

The thermo-bimetals 10, 11 face one another with their active sides (FIG. 4). They are heated by PTC resistors 34, 35. The PTCs 34, 35 are connected to voltage by way of reeds 14*a* and 39 and 15*a* and 39, respectively. If the contacts 14*a*, 39 are connected to voltage in the unlocked position according to FIG. 2, the PTC resistor 34 is heated and the moving end 18 of the bimetal 10 pivots counter-clockwise. The coupling bridge 20 transmits this pivoting movement with very low friction onto the locking bar 2, which is moved to the left in the transverse direction 3 for locking.

The path of movement up to the stop of the coupling bridge 20 at the housing wide wall 32 is divided into two partial paths of approximately equal length. Traversing the first partial path requires the pivoting drive, which is initiated by the heating of the PTC 34 and effected by the outward bending of the bimetal 10; for this movement component, this drive also effects the compression of the tipping spring 28 until its longitudinal axis has reached the dead-center position, in which it is oriented at approximately a right angle to the transverse direction 3, that is, vertically in FIGS. 2 and 3. Once the dead-center position has been passed through, the tipping spring 28 expands and effects the further displacement drive for the coupling bridge 20 or the locking bar 2, independently of the heating of the PTC 34. In contrast, in the second movement component, this displacement movement, which originates from the tipping spring 28 and acts on the locking bar 2 and is now based on a purely-mechanical drive, opens the contact 40 between the reeds 14 and 14*a*, thereby interrupting the supply of current to the PTC 34. The second movement component for the locking movement is therefore independent of the electrical drive. It is effected solely by the tipping spring 28, and is not ended until the left end of the coupling bridge 20 impacts the inside housing wall 32. In this stopped position, the locking bar 2 is stabilized in its locked position (FIG. 3). At the same time, the contact 41 is closed, so the locking apparatus is in an initial position, ready to be unlocked.

The unlocking from the locked position shown in FIG. 3 is effected in that the reed 15*a* and the compression spring 37 are connected to voltage via the reed 39 for the supply of current to the PTC 35. The PTC 35 is heated, and the moving end 19 of the bimetal 11 pivots clockwise. The above-described tipping process effected by the tipping spring 28 is now completed in the opposite direction. After the dead-center position of the tipping spring 28 has been exceeded, the spring provides the further displacement drive for returning the coupling bridge 20 to the unlocked position (FIG. 2), which is likewise stabilized purely mechanically by the expansion of the tipping spring 28. The opening of the contact 41 cuts off the current supply to the PTC 35. Until the next switch, the system is again voltage-free. Because the transverse force of the tipping spring 28 is greater than the restoring force of the cooling bimetals 10, 11, the system also remains voltage-free in the respective switching positions (FIGS. 2, 3), even in the event of a voltage breakdown. Even bimetal stresses caused by relatively-high, machine-stipulated ambient temperatures are compensated by the opposing arrangement or action of the two bimetals 10, 11.

The coupling bridge 20 also effects the control of the signal contacts 42 of a signal device. Depending on the bridge's position, therefore, the status of the system can be ascertained externally at an arbitrary location.

The advantage of the locking apparatus lies in the extremely small dimensions of the unit. A stroke of, for example, 3 mm of the locking bar 2 suffices to lock the mechanism. The bistability of the two positions (locked and unlocked positions) is assured. The instantaneous position of the locking bar 2 is independent of any voltage breakdowns, and is maintained. The drive remains in its initial position if a voltage breakdown occurs during the switching process. Voltage is only applied to the bimetal or the PTC during the switching processes for locking and unlocking. The bimetals and PTCs are only slightly thermally stressed, so they assure a long service life. The system operates silently, in contrast to a magnet drive. The system automatically unlocks when it is connected to voltage. The energy requirement is very low, namely about 1 A over a maximum of 2 sec at 230 V. Lower voltages than the nominal voltage of 230 V can easily be employed to attain full functioning capability. The rod assembly necessary in other systems, such as a motor-driven drive, can be eliminated, because the locking lever 8 can be mounted directly to the device, for example.

What is claimed is:

1. An electrothermally-controlled locking and unlocking apparatus, comprising:

a housing;

a locking bar mounted on the housing for movement along a movement path between first and second end positions, one of the end positions being a locking position and the other of the end positions being an unlocking position;

a first bimetal drive for moving the locking bar part way along the movement path, from the first end position toward the second end position;

a second bimetal drive for moving the locking bar part way along the path, from the second end position toward the first end position;

a tipping compression spring which is compressed as either bimetal drive moves the locking bar from the respective end position to an intermediate position along the movement path, and then expands to urge the locking bar the rest of the way along the movement path to the other end position and to hold the locking bar securely at the other end position, wherein the first and second bimetal drives comprise first and second bimetal strip members that are mounted adjacent one another and approximately parallel to one another in the housing, the strip members having foot ends that are secured to the housing at adjacent positions, the strip members additionally having movable ends that are disposed adjacent one another and that are movable along a path approximately parallel to the movement path of the locking bar.

2. The locking apparatus according to claim 1, further comprising means for using energy released during expansion of the compression spring to shut off the bimetal drive.

3. The locking apparatus according to claim 1, wherein the locking bar and the first and second strip members are oriented as in the Greek letter ø.

4. The locking apparatus according to claim 1, wherein part of the compression spring is positioned outside of the moving ends of the strip members, and another part of the compression spring is positioned between the strip members.

5. The locking apparatus according to claim 4, wherein the compression spring is disposed inside the housing.

6. The locking apparatus according to claim 1, wherein a space is hollowed out of the locking bar to accommodate a housing projection that supports one end of the compression spring.

7. The locking apparatus according to claim 6, wherein the housing projection provides longitudinal guidance for the locking bar.

8. The locking apparatus according to claim 1, wherein the strip members and the locking bar have movement planes that coincide.

9. The locking apparatus according to claim 8, further comprising a signal device having contacts with a movement plane that essentially coincides with the movement planes of the locking bar and strip members.

10. The locking apparatus according to claim 1, further comprising electrical connecting contacts that are pressed into the housing on a housing side facing away from the locking bar.

11. The locking apparatus according to claim 10, wherein the housing comprises a lower housing part that is injection-molded from plastic, the lower housing part having a floor with housing projections, wherein the strip members are fixed in their positions between the housing projections, and wherein the housing further comprises a housing lid that holds the strip members in a common housing plane so as not to be lost.

12. The locking apparatus according to claim 1, further comprising a coupling bridge that is disposed between the movable ends of the strip members and the locking bar to couple the movable ends to the locking bar.

13. The locking apparatus according to claim 12, wherein the moving ends of the first and second strip members contact the coupling bridge.

14. The locking apparatus according to claim 13, wherein the coupling bridge has a recess which receives the movable end of one of the strip members in the manner of a knife-edge bearing.

15. The locking apparatus according to claim 12, wherein the compression spring is disposed between the locking bar and the coupling bridge.

16. The locking apparatus according to claim 12, wherein the coupling bridge has a flank facing the locking bar, the coupling bridge being in a driving connection with the locking bar at its flank facing the locking bar.

17. The locking apparatus according to claim 16, wherein the coupling bridge and the locking bar are in a driving connection with one another through a form-fitting engagement.

18. The locking apparatus according to claim 12, wherein the form-fitting engagement is a loose form-fitting engagement.

19. The locking apparatus according to claim 12, wherein at least one of the locking bar and the coupling bridge functions as a switching drive for an electrical position indication.

* * * * *